United States Patent [19]

Teleskivi

[11] 4,282,687

[45] Aug. 11, 1981

[54] FIRE RESISTANT STRUCTURE

[75] Inventor: Peter F. Teleskivi, Wandin North, Australia

[73] Assignee: Jacmir Nominees Pty. Ltd., St. Kilda, Australia

[21] Appl. No.: 74,538

[22] Filed: Sep. 11, 1979

[30] Foreign Application Priority Data

Sep. 12, 1978 [AU] Australia ..... PD5909

[51] Int. Cl.[3] ..... E06B 3/00; E06B 3/82; E06B 5/16

[52] U.S. Cl. ..... 49/503; 49/501; 52/785; 52/809; 428/920; 428/224; 428/688

[58] Field of Search ..... 52/785, 792, 809; 49/501, 503; 428/538, 920

[56] References Cited

U.S. PATENT DOCUMENTS

| | | | |
|---|---|---|---|
| 1,931,125 | 10/1933 | Balduf | 52/785 X |
| 3,462,341 | 8/1969 | Littin | 52/785 X |
| 3,866,370 | 2/1975 | Guarino et al. | 52/809 X |
| 3,974,607 | 8/1976 | Balinski | 52/809 X |
| 4,104,828 | 8/1979 | Naslund et al. | 49/399 |
| 4,125,984 | 11/1978 | Jonas | 52/809 |

FOREIGN PATENT DOCUMENTS

| | | |
|---|---|---|
| 525519 | 5/1931 | Fed. Rep. of Germany . |
| 1288285 | 1/1969 | Fed. Rep. of Germany . |
| 1683349 | 11/1969 | Fed. Rep. of Germany . |
| 7002010 | 1/1970 | Fed. Rep. of Germany . |
| 2528245 | 2/1977 | Fed. Rep. of Germany . |
| 2619781 | 11/1977 | Fed. Rep. of Germany . |
| 1452245 | 8/1966 | France . |
| 2322996 | 11/1971 | France . |

OTHER PUBLICATIONS

European Search Copy Report 0008955, Dec. 12, 1979.

Page 1284 of Webster's Third New International Dictionary, G & C Merriam Company, Publishers, Springfield, Mass., U.S.A. 1963.

*Primary Examiner*—Henry F. Epstein

*Attorney, Agent, or Firm*—Finnegan, Henderson, Farabow, Garrett & Dunner

[57] ABSTRACT

A fire resistant structure, and in particular a fire door leaf, having no components of asbestos material, and comprising a sub-frame consisting of two spaced apart arrangements of sub-frame members between which a central panel in the form of a glass fiber reinforced gypsum sheet is attached and two other panels of high density compressed timber fiber board being attached to the sub-frame members on opposite sides of the structure to define, with the central panel, spaces in which insulating material in the form of mineral fiber batts is positioned, with the structure being completed on both faces by panels of sheet steel or wood veneer.

8 Claims, 5 Drawing Figures

L
24
5
5
34
32
30
L
10
11
24
10b
10a
38
40
36
38
36
24
10b
10a
16
16
26
26
20
20'
22
22
14

FIRE RESISTANT STRUCTURE

This invention relates to a fire resistant structure, such as a wall panel or fire door, and more particularly, but not exclusively relates to a fire door leaf and the following description will be in relation to the particular application of the invention to a fire door leaf.

Fire door assemblies comprise a door frame (usually zincanneal steel) and a door leaf adapted to operate as a swing door or as a sliding door, the leaf having a 1, 2 or 3 hour fire resistance, and an appropriate lock or latch-set and door closure. Assemblies are tested by the Commonwealth Building Station, Ryde, New South Wales, Australia in accordance with Australian Standard AS 1530, Part 4, 1976. The Australian Standard for a fire door leaf is AS 1905, and fire doors installed in Australian buildings must comply with that standard. A door leaf which complies with the Australian Standard will also comply with the standards of New Zealand, The United States of America, The United Kingdom and Western Europe.

Present fire door leaves, which comply with the standard, contain a proportion of asbestos fibre. In view of serious hazards to health caused by the use of asbestos in building products and heat insulation, there is a widespread tendency more to use alternative materials in place of asbestos. In addition present fire door leaves are heavy and accordingly it is often difficult to open and close the doors.

It is an object of this invention to provide a fire resistant structure which overcomes the abovementioned disadvantages.

The invention envisages a fire resistant door leaf structure including a sub-frame, central panel means, and a pair of outer panel means attached to the sub-frame, and insulating material between each outer panel means and the central panel means, the sub-frame comprising two spaced apart arrangements of vertically and horizontally extending sub-frame members between which the central panel means is situated, the sub-frame members being of substantially Z-shaped cross section and including a flat central web and two flat flanges extending away at right angles from opposite sides of the central web and substantially parallel to each other, the central panel means being connected to one of the flanges and one of the outer panel means to the other flange with the space defined between the central panel means, the outer panel means, and the central webs of the sub-frame members being filled with the insulating material.

Preferably, the central panel means is a glass fibre reinforced gypsum sheet, the outer panel means are high density compressed timer fibre board, and the insulating material is in the form of mineral fibre batts. One embodiment of the invention, as applied to a fine door, will now be described with reference to the accompanying drawings, in which:-

Figure 1:
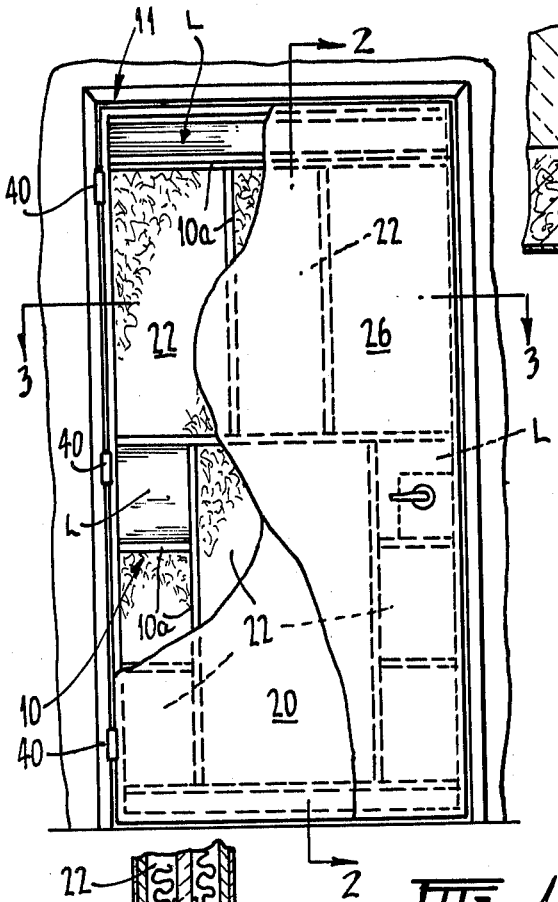
FIG. 1 is a side elevation of a fire door leaf.
Figure 2:
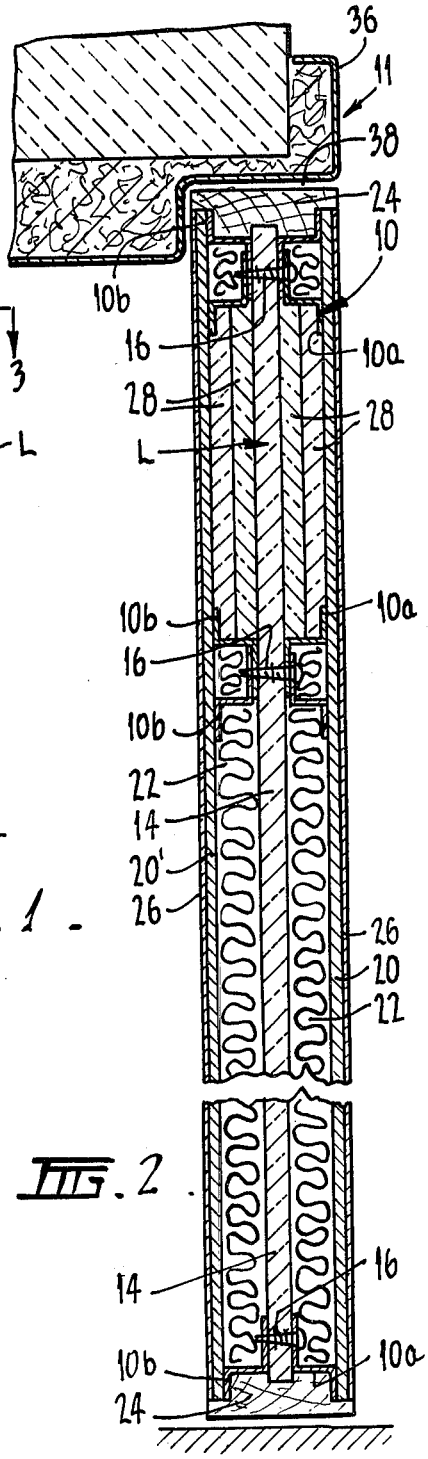
FIG. 2 is a cross-section along line 2—2 of FIG. 1, broken for part of its length.
Figures 3, 4:
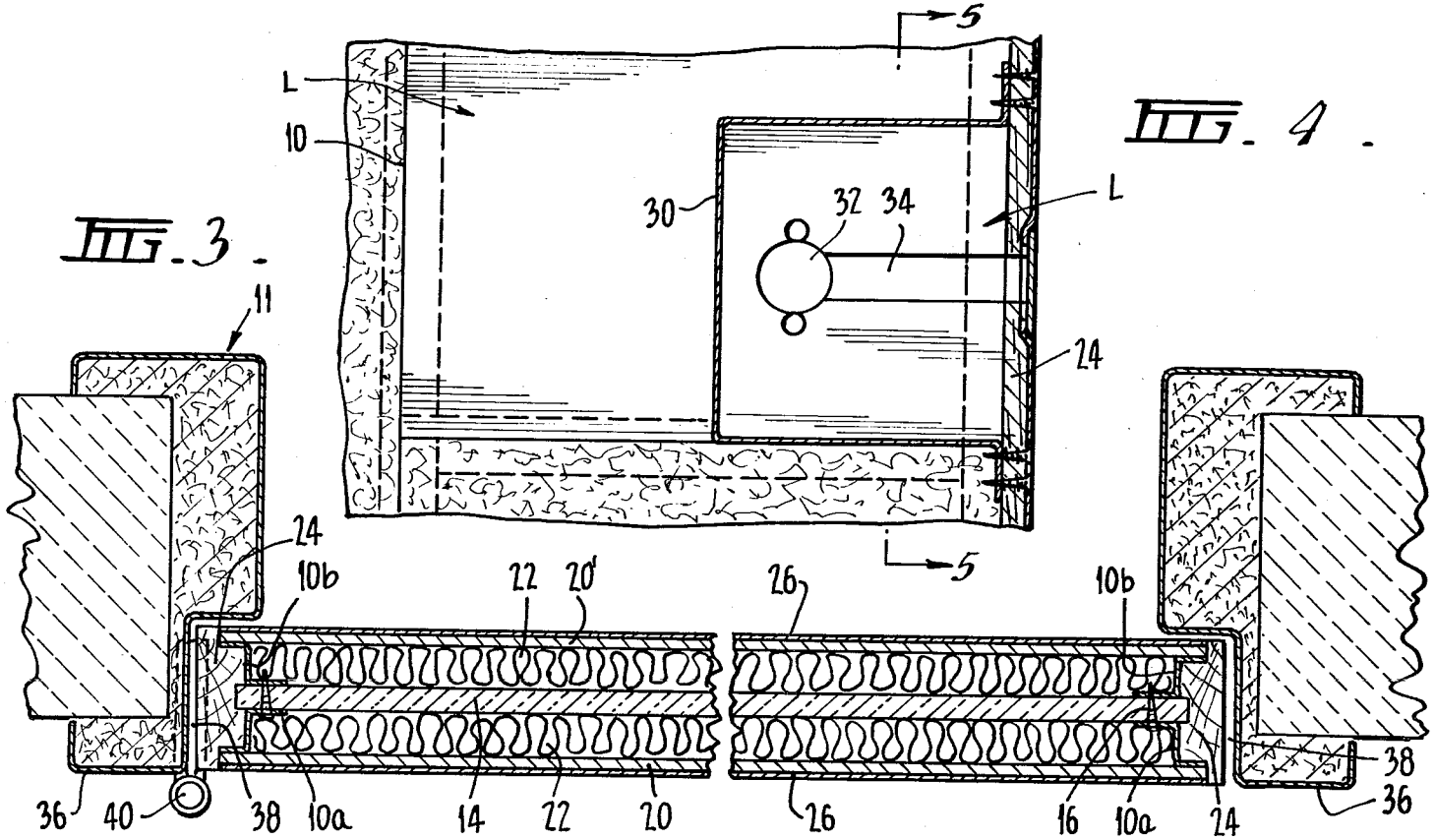
FIG. 3 is a cross-section along line 3—3 of FIG. 1 and also broken for part of its length.
FIG. 4 is a side elevational view of part of fire door leaf where a lock facility is to be incorporated.

FIG. 1 shows one fire door leaf within a door frame 11 and having sub-frame 10, formed from, preferably, an arrangement of members of a cold rolled steel section having a Z-shaped cross-section (i.e., comprising a flat central web and two flat flanges extending away at right angles from opposite sides of the central web and substantially parallel to each other), shown in FIG. 2 and FIG. 3, and welded or otherwise connected together.

Referring now to FIG. 2 and FIG. 3, the fire door leaf includes two spaced arrangements of sub-frame members 10*a* and 10*b* of z-shaped cross section, which are connected on either side to a central panel 14, and to each other by means of self tapping screws 16 or other means. The panel 14 is preferably a glass fibre reinforced gypsum sheet. The sub-frame and the central panel form a rigid inner structure.

Secured by screws (not shown) and/or adhesive or other means, to the outer portion of each of the sub-frame members 10*a* and 10*b* are outer panels 20, 20'. Preferably, the panels are high density compressed timber fibre board, and preferably any adhesive used is a non-organic adhesive.

Figure 5:
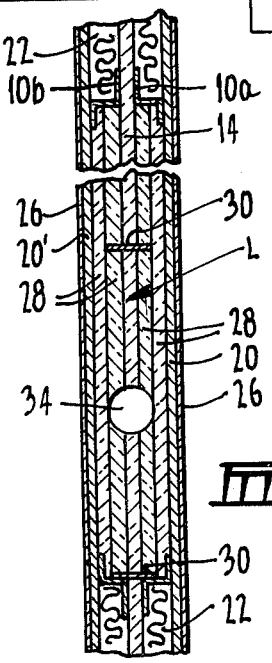
FIG. 5 is a cross-sectional view along line 5—5 of FIG. 4.

Between the central panel 14 and the outer panels 20, 20' there is disposed insulating material, preferably in the form of mineral fibre compressed batts 22, which are bonded to the central panel 14 and to the outer panels 20, 20' by an adhesive, preferably a non-organic adhesive. The material may be omitted from the leaf areas required for attachment to lock and door closer facilities, which areas are designated by L, with two areas for lock facilities being incorporated so as to allow for alternative lock positions to suit particular installations. As shown in FIG. 2 and FIG. 5, the area L consists of the central panel 14 and two additional fibre reinforced gypsum sheets 28 on either side all bonded together with metal foil sandwiched between adjacent sheets.

As shown in FIG. 4 and FIG. 5 the area L for the lock facility is surrounded by a steel plate 30 welded to the sub-frame members 10*a* and 10*b* and incorporates cut-outs 32 and 34 to receive the lock components.

Moulded edge timbers 24 may be fitted along the top, bottom and side edges of the structure and situated in a captive position in the sub-frame, and bonded thereto with adhesive, preferably a non-organic adhesive, and/or screws or other means. The outer surfaces on each side of the door leaf may be provided with a face veneer 26, which may be a metal sheet or a wood veneer, bonded to the outer panels 20, 20' by an adhesive, preferably a gap-filling non-organic adhesive.

As shown in FIG. 2 and FIG. 3 the door frame 11 comprises conventional frame members 36 and in the example shown are recessed at 38 to receive the side edges of the leaf and hinges 40 are provided at spaced positions along one of the side edges. Vision panels of the maximum allowable size (by regulation) may be optionally fitted to a door leaf, and may be fitted within the sub-frame by means of steel beads and aluminium face trim.

Return air grilles may also be provided. Such incorporate a fusible link operated double drop shutter housed within the steel sub-frame, to prevent air flow in times of fire.

It is to be understood that the fire door leaf as described may be used as a swing or slide door, as part of a fire door assembly.

It can be seen that the fire door leaf described herein overcomes disadvantages of present fire doors in that it contains no asbestos, and has a mass less than that of present doors, due to its construction and materials used therein, although the double sub-frame provides the door leaf with great strength.

Another advantage of the present door leaf is that a wood veneer may be selected, to match fire doors with non fire-rated doors in a building. At present, some fire doors have metal surfaces, and if a wood veneer surface is required, it must be attached to the metal surfaces increasing costs.

In addition, all the materials used in the door construction are readily available and inexpensive.

I claim:

1. A fire resistant door or door leaf structure including a sub-frame, central panel means, and a pair of outer panel means attached to said sub-frame, and insulating material between each said outer panel means and said central panel means, said sub-frame comprising two spaced apart arrangements of vertically and horizontally extending sub-frame members between which the central panel means is situated, said sub-frame members being of substantially Z-shaped cross-section and including a flat central web and two flat flanges extending away at right angles from opposite sides of said central web and substantially parallel to each other, said central panel means being connected to one of said flanges and one of said outer panel means to the other flange, with the space defined between said central panel means, said outer panel means, and the central webs of said sub-frame members being filled with said insulating material.

2. A fire resistant door or door leaf structure as claimed in claim 1, wherein the central panel is a glass fibre reinforced gypsum sheet.

3. A fire resistant door or door leaf structure as claimed in claim 1, wherein the outer panel means are high density compressed timber fibre board.

4. A fire resistant door or door leaf structure as claimed in claim 1, wherein the insulating material is in the form of mineral fibre batts.

5. A fire resistant door or door leaf structure as claimed in claim 1, wherein the central and outer panel means are attached to said sub-frame members by self tapping screws, and the panel means and the insulating material are bonded to each other by an adhesive.

6. A fire resistant door or door leaf structure as claimed in claim 1, wherein both faces of said structure are completed by panels of sheet steel or wood veneer.

7. A fire resistant door or door leaf structure as claimed in claim 6, wherein the sheet steel or wood veneer panels are bonded to said outer panel means.

8. A fire resistant door or door leaf structure as claimed in claim 1, wherein portions of said structure to which lock and/or door closure facilities are to be incorporated or attached are devoid of said insulating material and incorporate a laminate of additional panel means between said central and said outer panel means.

* * * * *